US009200763B2

(12) United States Patent
Schnobrich et al.

(10) Patent No.: US 9,200,763 B2
(45) Date of Patent: Dec. 1, 2015

(54) FLEXIBLE LIGHTING ASSEMBLY

(75) Inventors: Scott M. Schnobrich, Stillwater, MN (US); Bing Hao, Woodbury, MN (US); David A. Ender, New Richmond, WI (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 102 days.

(21) Appl. No.: 14/117,533

(22) PCT Filed: May 1, 2012

(86) PCT No.: PCT/US2012/035998

§ 371 (c)(1),
(2), (4) Date: Nov. 13, 2013

(87) PCT Pub. No.: WO2012/158339

PCT Pub. Date: Nov. 22, 2012

(65) Prior Publication Data

US 2014/0268792 A1 Sep. 18, 2014

Related U.S. Application Data

(60) Provisional application No. 61/486,078, filed on May 13, 2011.

(51) Int. Cl.

| | |
|---|---|
| ***F21K 99/00*** | (2010.01) |
| ***F21V 21/32*** | (2006.01) |
| ***F21V 19/00*** | (2006.01) |
| ***F21S 4/00*** | (2006.01) |
| *F21Y 103/00* | (2006.01) |

(52) U.S. Cl.

CPC . *F21K 9/50* (2013.01); *F21S 4/001* (2013.01); *F21S 4/003* (2013.01); *F21V 19/0025* (2013.01); *F21V 21/32* (2013.01); *F21Y 2103/003* (2013.01)

(58) Field of Classification Search

CPC ..... F21K 9/50; F21V 19/0025; F21V 21/32
See application file for complete search history.

(56) References Cited

U.S. PATENT DOCUMENTS

| | | | | |
|---|---|---|---|---|
| 5,672,000 | A * | 9/1997 | Lin | 362/249.06 |
| 5,931,577 | A * | 8/1999 | Ishibashi | 362/249.04 |
| 6,473,554 | B1 * | 10/2002 | Pelka et al. | 385/146 |
| 8,398,261 | B2 * | 3/2013 | Nall et al. | 362/219 |
| 2005/0207151 | A1 * | 9/2005 | Aanegola et al. | 362/227 |
| 2006/0180821 | A1 * | 8/2006 | Fan et al. | 257/98 |

FOREIGN PATENT DOCUMENTS

| | | | |
|---|---|---|---|
| CN | 201273496 | Y | 7/2009 |
| WO | WO 02097770 | A2 | 12/2002 |
| WO | WO 03081967 | A1 | 10/2003 |
| WO | WO 2009086032 | A1 | 7/2009 |

* cited by examiner

*Primary Examiner* — Elmito Breval

(74) *Attorney, Agent, or Firm* — Yufeng Dong; Daniel J. Iden

(57) ABSTRACT

Flexible lighting assemblies (100) are disclosed. Specifically, flexible lighting assemblies that are made up of a flexible cable (102), a plurality of light emitting diodes (112), and a plurality of transparent light distribution segments (116) that distribute light along the length of the cable by deflectors positioned over the light emitting diodes. The lighting assembly allows for flexible lighting without the glare and non-uniformity problems often associated with flexible lighting.

21 Claims, 5 Drawing Sheets

FLEXIBLE LIGHTING ASSEMBLY

FIELD

The present description relates to flexible lighting assemblies. More particularly, the present description relates to flexible lighting assemblies that are made up of a flexible cable, a plurality of light emitting diodes, and a plurality of transparent light distribution segments that distribute light along the length of the cable by deflectors positioned over the light emitting diodes.

BACKGROUND

Flexible cable lighting has become as increasingly popular manner of providing lighting in a number of applications, including advertising, automotive, manufacturing, architectural, backlighting and any other number of applications where it is desired that a light source conform to an underlying structure.

SUMMARY

In one aspect, the present description relates to a flexible lighting assembly. The flexibility lighting assembly includes a flexible cable, a plurality of light emitting diodes, and a plurality of light distribution film segments. The flexible cable has a width and thickness, and includes electrical conductors that provide electrical circuit paths. The plurality of light emitting diodes are electrically connected to the electrical conductors in the flexible cable, The light emitting diodes are further made up in part of leads that are placed against a first exterior side of the flexible cable. The plurality of light distribution film segments are positioned on the first exterior surface of the flexible cable. Each light distribution film segments corresponds to a given light emitting diode, and each segment has a top surface generally parallel to the flexible cable and two side surface that run between the top surface and the first exterior surface of the flexible cable at opposing ends of each segment. Each distribution film segment includes a light deflector that is positioned directly over the corresponding light emitting diode. The light deflector redirects light emitted from the light emitting diode in a direction generally towards one of the side surfaces of the side surfaces of the segment. The side surface of one segment is spaced apart from the closest side surface of an adjacent segment by a gap on the flexible cable. In some cases, the flexible lighting assembly may also include a heat sink sheet material having a thermal conductivity of at least 25 W/m–K thermally attached to a second side of the flexible cable generally opposite the light emitting diodes, and not in direct physical contact with any of the light emitting diodes on the flexible cable. In some cases, the electrical conductors are insulated by electrical insulation. The electrical insulation may have a plurality of removed portions that each expose a surface mounting area on the first exterior surface, where the light emitting diodes are soldered to a respective soldering area.

In a second aspect, the present description relates to another flexible lighting assembly. The flexibility lighting assembly includes a flexible cable, a plurality of light emitting diodes, and a plurality of light distribution film segments. The flexible cable has a width and thickness, and includes electrical conductors that provide electrical circuit paths. The plurality of light emitting diodes are electrically connected to the electrical conductors in the flexible cable, The light emitting diodes are further made up in part of leads that are placed against a first exterior side of the flexible cable. The plurality of light distribution film segments are positioned on the first exterior surface of the flexible cable. Each light distribution film segments corresponds to a given light emitting diode, and each segment has a top surface generally parallel to the flexible cable and two side surface that run between the top surface and the first exterior surface of the flexible cable at opposing ends of each segment. Each distribution film segment includes a light deflector that is positioned directly over the corresponding light emitting diode. The light deflector redirects light emitted from the light emitting diode in a direction generally towards one of the side surfaces of the side surfaces of the segment. The light distribution film has a Young's Modulus of between about 0.05 and about 0.50 and an index of refraction of between about 1.45 and about 1.60, and is capable of flexing with the flexible cable. In some cases, the flexible lighting assembly may also include a heat sink sheet material having a thermal conductivity of at least 25 W/m–K thermally attached to a second side of the flexible cable generally opposite the light emitting diodes, and not in direct physical contact with any of the light emitting diodes on the flexible cable. In some cases, the electrical conductors are insulated by electrical insulation. The electrical insulation may have a plurality of removed portions that each expose a surface mounting area on the first exterior surface, where the light emitting diodes are soldered to a respective soldering area.

In another aspect, the present description relates to a third flexible lighting assembly. The flexibility lighting assembly includes a flexible cable, a plurality of light emitting diodes, and a plurality of light distribution film segments. The flexible cable has a width and thickness, and includes electrical conductors that provide electrical circuit paths. The plurality of light emitting diodes are electrically connected to the electrical conductors in the flexible cable. The light emitting diodes are further made up in part of leads that are placed against a first exterior side of the flexible cable. The plurality of light distribution film segments are positioned on the first exterior surface of the flexible cable. Each light distribution film segments corresponds to a given light emitting diode, and each segment has a top surface generally parallel to the flexible cable and two side surface that run between the top surface and the first exterior surface of the flexible cable at opposing ends of each segment. Each distribution film segment includes a light deflector that is positioned directly over the corresponding light emitting diode. The light deflector redirects light emitted from the light emitting diode in a direction generally towards one of the side surfaces of the side surfaces of the segment. The flexible lighting assembly is capable of being bent between two adjacent light emitting diodes around a 25 mm diameter rod without damaging the electrical circuit paths, light emitting diodes, or cable.

DETAILED DESCRIPTION

Flexible cable lighting is an increasingly popular manner of providing lighting in a wide variety of applications, especially applications where a light source must preferably conform to some underlying structure that is not flat. Unfortunately, it is difficult to achieve uniform lighting without bright spots in many flexible cable lighting applications. Most flexible cable lighting assemblies make use of light emitting diodes as a light source due to their energy efficiency, and also because their small size is conducive to being placed on a flexible surface. Unfortunately, light emitting diodes are extremely bright and it may be difficult to disperse the light from the light emitting diode before reaching a viewer when the light emitting diode is positioned on a curved surface. The result is non-uniform bright spots and glare for the viewer. It would be desirable to have a flexible lighting assembly that could achieve greater lighting uniformity and less bright spots while not sacrificing the flexibility of the assembly. The present description provides for such an assembly.

Figure 1:
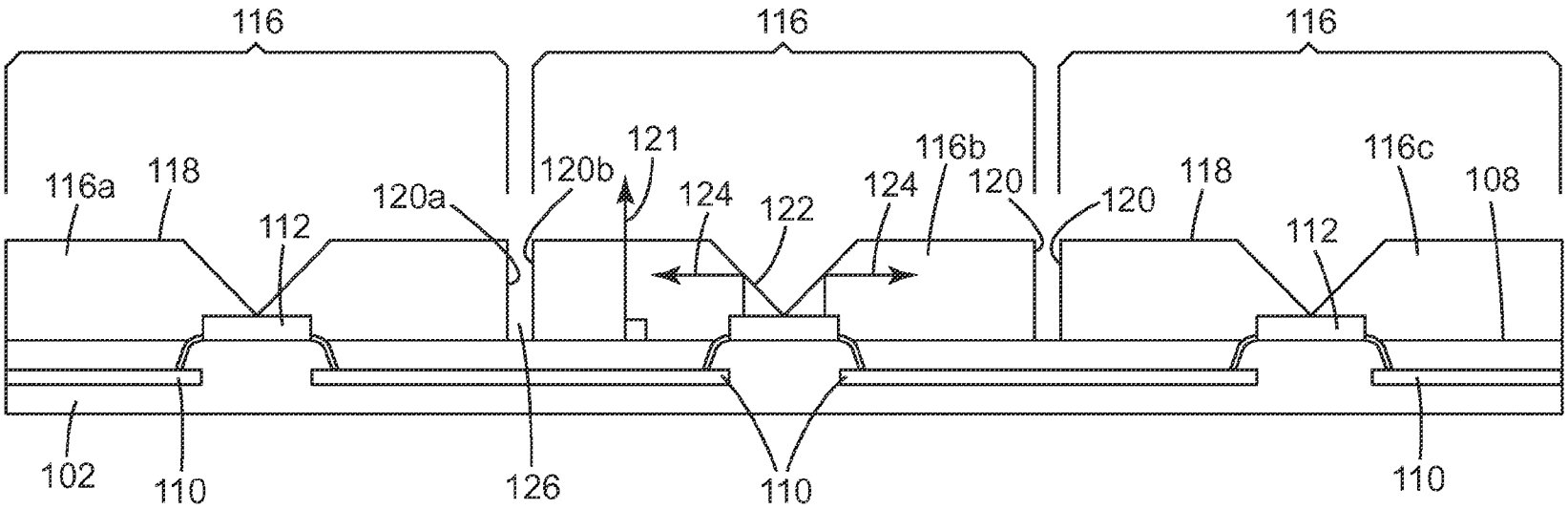
FIG. 1 is a cross-sectional view of a flexible cable lighting assembly according to the present description.
Figure 2:
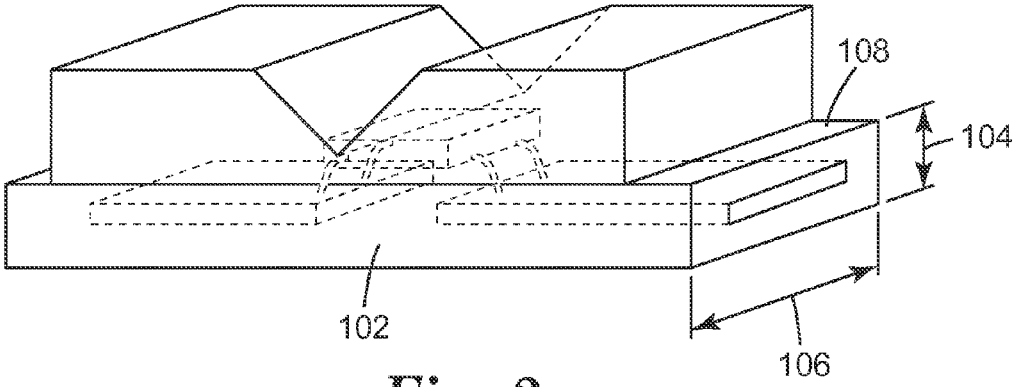
FIG. 2 is a perspective view of a portion of a flexible cable lighting assembly according to the present description.

One embodiment of an article according to the present description is illustrated in FIG. 1. Flexible lighting assembly 100 is made up of a number of elements. The flexible lighting assembly 100 has a flexible cable 102 underlying the entire assembly. As shown in FIG. 2, the cable is not a cable in the manner of a rounded electrical cable commonly found in the art, but rather a cable 102 that has both a thickness 104, and also a width 106, that may in many embodiments be greater than the thickness such that elements, such as light emitting diodes, may be securely positioned on the first exterior surface 108 of the cable 102. Returning, to FIG. 1, the cable also is made up in part of electrical conductors 110 that provide electrical circuit paths throughout the cable 102.

Exemplary widths of the flexible cable range from 10 mm to 30 mm. Exemplary thicknesses of the flexible cable range from 0.4 mm to 0.7 mm. Suitable flexible cables are known in the art, and include those marketed by Parlex USA, Methuen; Leoni A G, Nuremburg, Germany; and Axon' Cable S.A.S., Montmirail, France.

Figure 3:
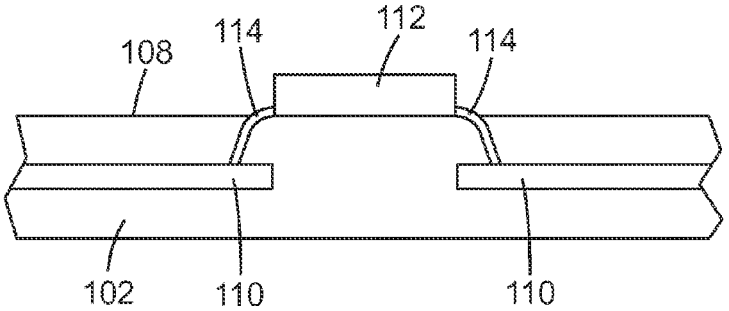
FIG. 3 is a close-up view of a portion of a flexible cable lighting assembly according to the present description.

In addition to the flexible cable 102, the flexible lighting assembly 100 is also made up in part of a plurality of light emitting diodes 112. As shown by the close-up view illustrated in FIG. 3, each of the light emitting diodes 112 is connected to the electrical conductors 110 of the flexible cable. The light emitting diodes 112 each include leads 114 that are placed against the first exterior surface 108 of the flexible cable. The leads may generally electrically couple to the conductors 110 of the flexible cable. It should be noted that this figure provides a simplistic manner of the coupling between the conductors of the cable and the LED leads. A number of other elements related to both heat management (e.g. heat-sinking, insulation), and conductivity may also be included along with the leads and conductor. Such elements may be discussed further below.

Suitable light emitting diodes are known in the art, and commercially available. LEDs are available in a variety of power usage ratings, including those ranging from less than 0.1 to 5 watts (e.g., power usage ratings up to 0.1, 0.25, 0.5, 0.75, 1, 1.25, 1.5, 1.75, 2, 2.5, 3, 4, or even up to 5 watts) per LED. LEDs are available in colors ranging range from violet (about 410 nm) to deep red (about 700 nm). A variety of LED colors are available, including white, blue, green, red, amber, etc. In some embodiments of light assemblies described herein, the distance between LEDs may be at least 50 mm, 100 mm, 150 mm, 200 mm, or even at least 250 mm or more. In some embodiments of light assemblies described herein have at least 2, 3, 4, or even at least 5, light emitting diodes per length of, for example, per 300 mm.

Returning to FIG. 1, a plurality of light distribution film segments 116 are also positioned on the first exterior surface 108 of the flexible cable. Each light distribution film segment 116 corresponds to a given light emitting diode 112. For purposes of this description a light distribution film segment corresponds to the light emitting diode that it is in closest proximity to, and thus primarily receives light from. For example, looking to the far right of FIG. 1, one may understand that light distribution film segment 116 corresponds to light emitting diode 112 by being positioned directly over this light emitting diode. On top of each of the light distribution film segments is a top surface 118. The top surface 118 may generally run along a plane that is close to parallel to the first exterior surface 108 of the flexible cable. In some embodiments the top surface 118 may not be parallel to the first exterior surface 108, but generally the difference in angle between plane of the top surface 118 and the first exterior surface 108 cable will be very small (e.g., less than 20 degrees and more likely less than 10 degrees), and most certainly will be less than the angle with which the top surface 118 intersects the normal to the first exterior surface 121. Thus, for purposes of this description, "generally parallel" shall mean less than 20 degrees, and likely less than 10 degrees between the surfaces described above. In some embodiments however, the angle between the plane of the top surface 118 and first exterior surface 108 will be less than 5 degrees, or less than 3 degrees, or less than 1 degree.

Each light distribution film segment 118 is also made up of two side surfaces 120 that run between the segment top surface 118 and the cable first exterior surface 108. The side surfaces 120 of each segment are located at opposing ends of the light distribution film segment 118 from one another. Between the side surfaces 120 of the light distribution film segment and generally positioned directly over the light emitting diode 112 is a light deflector 122. Light 124 that is emitting from light emitting diode in a direction close to normal 121 is immediately incident upon deflector 122. The light 124 is then immediately redirected down the length of the distribution film 116 in a direction generally towards one of the side surfaces 120. In the embodiment illustrated in FIG. 1, the light deflector 122 is actually a recess formed into the top surface of the distribution film segment. In such a case, the light from the light emitting diode 112 is generally deflected by total internal reflection. However, other light deflectors and manners of reflecting the light (besides total internal reflection) are also contemplated and will be disclosed.

In some embodiments, the light distribution film segments will not be in direct contact with adjacent counterparts. For example, FIG. 1 illustrates such a case. Light distribution film segment **116*b* is directly adjacent to light distribution film segment 116*a*. The side surface 120*b* of segment 116*b* is spaced apart from directly adjacent side surface 120*a* of segment 116*a* by a gap 126 on the flexible cable. In some embodiments, this gap may be air. In such cases, the gap may allow for some light 124 to be redirected back into the light distribution film segment 116*b* when it reaches side surface by means of Fresnel reflection and some light to pass through into the adjacent segment. In addition, where the segments 116 are not as flexible as cable 102, the air gap 126 may help to flex the plurality of segment apparatuses along with the cable. Of course, a number of embodiments, and accompanying materials are contemplated where no air gap is needed to achieve the necessary flexibility of a flexible lighting apparatus even without air gaps 126**.

In order to properly determine whether or not a flexible lighting assembly is in fact "flexible" as is desired for the current lighting assemblies, one may assess the assembly and materials making up the assembly by a variety of factors and tests. One such test is the bend radius that may be achieved between two adjacent light emitting diodes. In the current description, "flexible" may be understood to mean that flexible cable alone may be wrapped around a 25 mm diameter rod without breaking or damaging the lighting function of the lighting, heat sink, or cable, as applicable. In addition, each of the light distribution film segments disclosed herein is understood to be capable of flexing with the flexible cable, and thus also is capable of wrapping around a 25 mm diameter rod, where the bend occurs between two adjacent light emitting diodes without damaging the distribution film segments.

Figure 4:
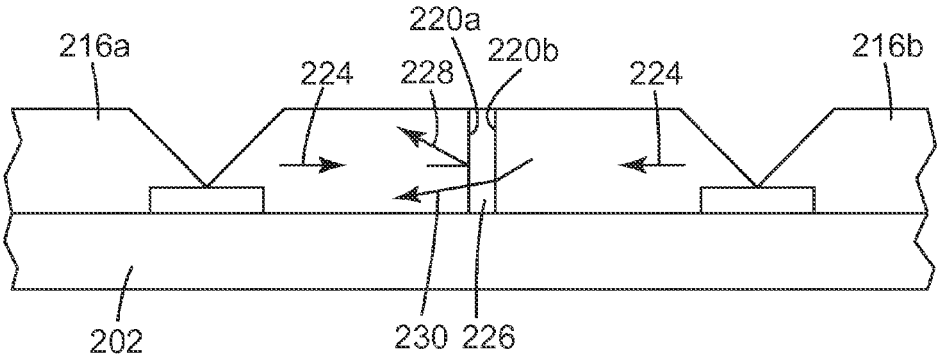
FIG. 4 is a close-up view of a portion of a flexible cable lighting assembly according to the present description.

As mentioned, in at least some embodiments where a gap 126 is placed between segments 116, the gap may not be filled with any material and therefore may be understood as an air gap. This air gap may reflect some light back into the segment that reaches side surface 120 without being extracted. In at least some embodiments, this gap may reflect a majority of light incident upon it back towards the light emitting diode if it is coated with a reflective material. Where it is desired that light is reflected back, other reflecting means may also be used to fill gap 126. For example, looking to FIG. 4, gap 226 may be filled with a metalized and/or mirrored layer that is highly reflective such as an aluminum vapor coating or an enhanced specular reflector. As such, again light 224 that travels towards side surface 220*a* may be reflected back into the segment 216*a* as light 228. In other embodiments, it may be desired that light be allowed to travel from one light distribution film segment (e.g. 216*b*) to an adjacent light distribution segment (e.g. 216*a*). This may allow for even greater light distribution and uniformity across the flexible lighting assembly. In such a case, as also shown in FIG. 4, gap 126 may be filled with a material that is closely matched in index of refraction to the light distribution film segments 216*a* and 216*b*. For example, the material may have an index of refraction that is within 0.3 or within 0.2 or within 0.1 of the index of refraction of the distribution film segments. This match or near-match in index of refraction allows light 224 to travel from segment 216*b* through layer 225 and into 216*a*, as illustrated by light ray 230. Where such a material is used, it is also often desirable that the material be flexible in nature to accommodate the flexing of the cable 202 and film segments 216(*a, b*). The index-matching material filling gap 226 may have a Young' Modulus of greater than zero and less than or equal to 1, more preferably less than or equal to 0.5, or less than or equal to 0.25 and potentially less than or equal to 0.10.

Figure 5:
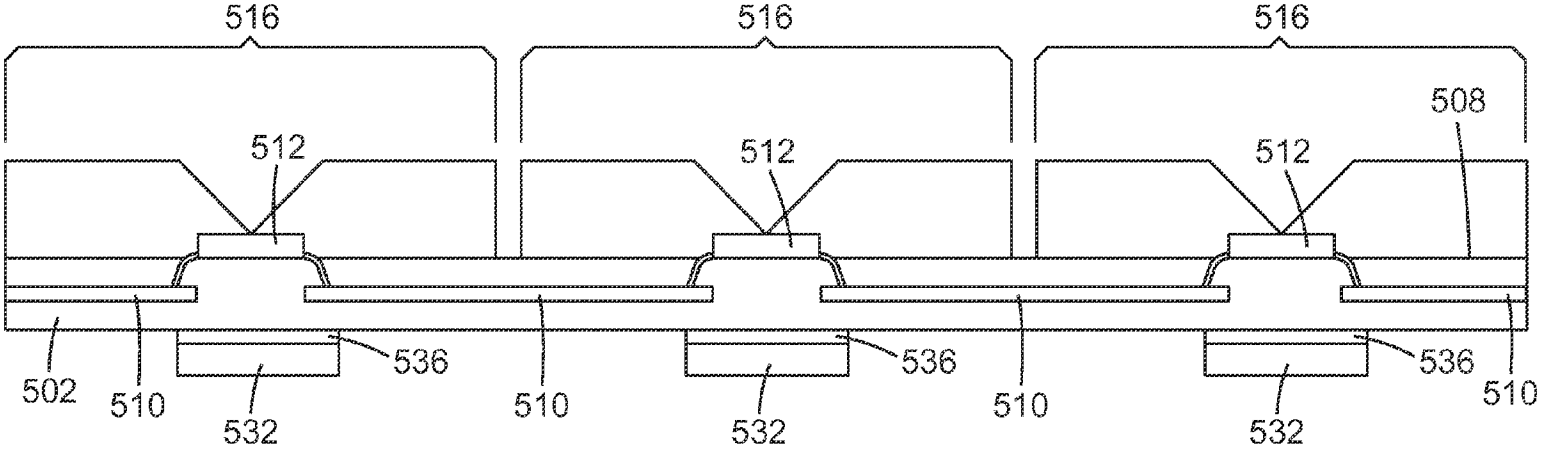
FIG. 5 is a cross-sectional view of a flexible cable lighting assembly according to the present description.

As noted earlier, the flexible lighting assemblies described herein may include further elements that affect both the heat management of the device (namely the LEDs) as well as the conductivity of the device. FIG. 5 provides one example of an embodiment including at least one such element.

Flexible lighting assembly 500, illustrated in FIG. 5, includes a flexible cable 502, as well as light emitting diodes 512 and light distribution film segments positioned on the first exterior surface 508 of the cable. In addition, the lighting assembly includes a number of electrical conductors 510 within the flexible cable that couple to leads of the light emitting diodes 512. The flexible lighting assembly 500 includes other elements for managing the heat of light emitting diodes 512. Specifically, the assembly includes heat sinking material 532 applied to a second surface 534 of the cable that is opposite the first surface 508 and light emitting diodes 512. The heat sinking material may be thermally attached to the second surface 534, but generally will not be in any direct physical contact with any of the light emitting diodes 512 that are connected to the flexible cable. In at least some embodiments, the heat sink material 532 may be thermally attached to the second surface 534 by a thermally conductive adhesive 536. The thermally conductive adhesive 536 may be any appropriate thermally conductive adhesive known in the art.

Heat sinks may act to draw out waste heat from the high power light emitting diodes 512. This is especially important as waste heat may result in excessive junction temperatures, degrading performance, and reduced device life. The flexible heat sink material accomplishes this draw of heat by its level of thermal conductivity. Specifically, the flexible heat sink material may have a thermal conductivity of at least 25 W/m–K (in some embodiments, at least 50, 100, 150, 200, 250, 300, 350, 400, 450, or even at least 500 W/m–K; in arrange, for example, from 25 to 500, 200 to 500, or even 200 to 450 W/m–K). In cases, such as those illustrated in FIG. 8, where a clamp is used to mechanically couple or fasten the light distribution film segments to the flexible cable, the clamp itself (e.g. 162 in FIG. 8) may act as a heat sink drawing heat from the light emitting diode. In such a case, the portion of the clamp that is located on the opposite side of cable 102 from light emitting diode 112 will act as the heat sink and may be composed of a metal. The remainder of the clamp may also be composed of metal, although any other appropriate materials for producing a clamp (e.g. plastic, etc.) are also contemplated.

The flexible heat sink sheet material can be made of metal (e.g., at least one of silver, copper, aluminum, lead, or an alloy thereof). In some embodiments, the flexible heat sink sheet has a thickness not greater than 0.45 mm, 0.4 mm, 0.35 mm, 0.3 mm, 0.25 mm, 0.2 mm, 0.15 mm, or even not greater than 0.1 mm. In some embodiments, the exposed surface area of the flexible heat sink sheet material is in a range from 350 $mm^2$ to 1600 $mm^2$. In some embodiments, the exposed surface area of the flexible heat sink sheet material is in a range from 45 percent to 100 percent of the outer surface area of the flexible cable. Therefore, although shown as discrete segments directly below the LEDS 512 in FIG. 5, the flexible heat sink material 532 may be a continuous layer along the second surface 534 of the flexible cable.

Figure 6:
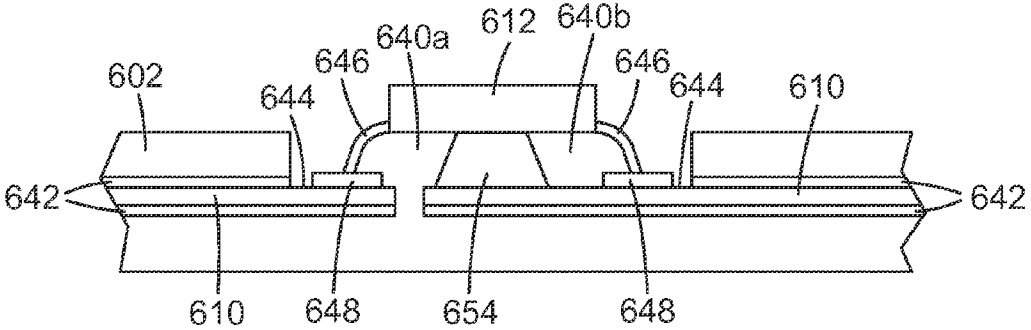
FIG. 6 is a close-up view of a portion of a flexible cable lighting assembly according to the present description.

A more detailed view of how one LED in the plurality of LEDs may be coupled to the flexible electrical cable, in accordance with the description provided directly above, is shown in FIG. 6. Although not shown in this great of detail, this manner of coupling the LEDs to the conductors of the electrical cable may be present in all of the embodiments discussed thus far. An apparatus for which the LEDs may be surface mounted to the first exterior surface of the cable by soldering, by first removing electrical insulation from the cable may be found, e.g., in FIGS. 2A and 2B and the accompanying description of commonly owned and assigned U.S. Patent Publication No. 2011/0007509 A1, which is hereby incorporated by reference in its entirety.

As shown in FIG. 6, the flexible electrical cable 602 again comprises electrical conductors 610. The close-up view from FIG. 6 illustrates the electrical insulation 642 that surrounds the electrical conductors 610 in the cable 602. Although the electrical insulation is shown separate from the remainder of cable 602 outside of conductors 610, in some embodiments, the electrical insulation itself may make up the entirety of the cable outside of conductors 610. In order to properly couple the LED to the conductors 610, a portion of the insulation is removed, potentially by one of the discussed methods discussed below, resulting in removed portion 640*a,b*. This removed portion 640*a,b* may serve as a surface mounting area 644 on the electrical conductors 610. On top of this mounting area 644, a solder joint 648 may be placed. The leads 646 from the LED 612 may then be soldered to the solder joint 648, and by extension soldered to the electrical conductors 610, resulting in electrical connection between the LED 612 and conductors 610. After the circuit has been created to the LED, the solder joint 848 and exposed area of conductors 610, as well as the lead connection may be covered by some sort of encapsulant to protect the circuitry.

Looking at FIG. 6 in greater detail, The flexible electrical cable 602 can be a flat flexible electrical cable or FFC and, as discussed, the cable can comprise a plurality of spaced apart electrical conductors 610 insulated from one another such as, for example, by being sheathed in and separated by electrical insulation 642 (e.g., an electrically insulating polymeric material), with the electrical conductors being relatively flat and having a generally rectangular cross section. The desired amount of electrical insulation can be removed by any suitable process including, for example, by laser ablating. It may be desirable to remove a portion of the electrical insulation to expose multiple surface mounting areas 644 on the surface of one or more of the electrical conductors of the flexible electrical cable, depending on how many electronic devices are to be surface mounted onto the cable. One or more of the electrical conductors can each be isolated into two or more electrically isolated surface mounting areas, which are electrically isolated from each other, by removing sections (e.g., by mechanically die cutting or punching) of the affected conductor. It is preferred to surface mount the light emitting diode 612 or any other electronic device to the electrical conductor by forming a solder joint 648 using a solder paste. It is desirable to insert injection mold a thermoplastic polymeric molding material so as to encapsulate (i.e., overmold) the desired a length of the flexible electrical cable. Preferably, this length of encapsulated cable 650 includes any of the exposed mounting areas and any solder joint. In other embodiments, as will be discussed below and in the embodiment illustrated in FIG. 8, the overmold may be replaced, for example, with a clamp that may both register and attach the distribution film to the cable.

The present method can further comprise soldering the heat slug of the light emitting diode to the mounting area of the conductor on which either the anode lead or the cathode lead is soldered. However, in other embodiments, the LEDs may be constructed such that the thermal slug is electrically isolated from the anode and cathode. This may allow the heat conductor to extend the entire length of the cable without any discontinuities.

The removing step can include removing enough electrical insulation such that the mounting area of the electrical conductor that is exposed is sufficient to allow the heat slug to be soldered thereon, and the method can further comprise soldering the heat slug of the light emitting diode to the mounting area of the conductor on which either the anode lead or the cathode lead is soldered. This is shown, e.g. by removed portion 640*b* that in this embodiment is shown as wider than removed portion 640*a*. The removed portion 640*b* of insulation 642 is wide enough that it allows for a surface mounting area that can accommodate the soldering of a heat slug 654 to cathode 610 as well as the cathode or anode lead 646.

The encapsulated length of the flexible electrical cable is, preferably, sufficiently stiff and inflexible to prevent the flexible electrical cable from flexing or bending enough to damage any solder joint bonding the light emitting diode to the electrical conductor. The clamps discussed with respect to FIG. 8 may also take on this role.

It can be desirable for the encapsulated length of the flexible electrical cable to include a raised protective ridge (e.g., a continuous or discontinuous ridge of the polymeric molding material) formed around the exposed portion of the light emitting die of the light emitting diode, and the raised protective ridge.

As discussed throughout, one of the necessary elements of the articles described herein is the light distribution film segments 116 that are positioned over the flexible electrical cable and light emitting diodes. Of course, in addition to being flexible themselves, the light distribution film segments must be securely attached to the flexible electrical cable. Various methods of securing the light distribution film segments 116 to the flexible cable 102 are contemplated.

Figure 7:
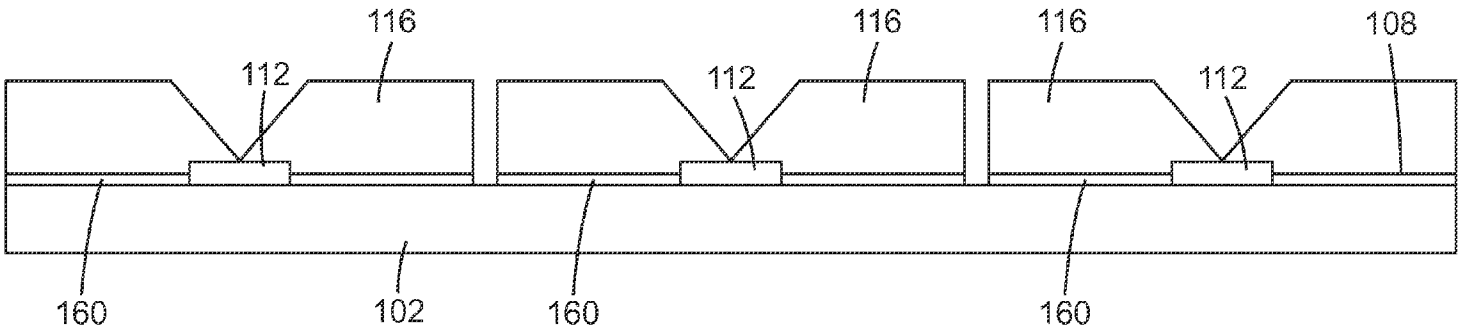
FIG. 7 is a cross-sectional view of a flexible cable lighting assembly according to the present description.

One manner of securing the light distribution film segments 116 to the flexible cable 102 is illustrated in FIG. 7. In this embodiment, an adhesive layer 160 is deposited on top of the first surface 108 of the flexible cable 102. In some embodiments, adhesive layer 160 will be transparent to visible light. However, the adhesive layer may also be reflective. The distribution film segments 116 are then applied on top of the adhesive layer 160 and the adhesive layer mechanically couples, fastens or bonds the two portions together. In some embodiments, no adhesive layer 160 will be applied over the LED 112. The adhesive layer may be made up of any number of suitable adhesive known in the art. In many embodiments, the adhesive will have a low index of refraction, as this may encourage reflection of light traveling through the film segments 116 away from the cable 102. For example the adhesive layer 160 may have an index of refraction of less than 1.4, or less than 1.3, or more preferably, even less than 1.25. In such a case, the distribution film may have an extractor layer positioned between it and the adhesive layer. The adhesive layer must be generally transparent to avoid loss of higher angle rays that miss or move through the extractors. In addition, such an embodiment may further include a reflective layer positioned between the flexible cable and the adhesive layer. A separate adhesive layer may also attach the reflective layer to the cable. Alternatively, the top surface of the cable itself may be reflective, with extraction features (e.g. printed white dots) located on the cable. In other cases, the adhesive layer may have an index of refraction matched or nearly matched to the distribution film. In such a case, the adhesive layer may also serve to guide light away from the deflector in the same manner as the distribution film. Thus, it may be important in such an embodiment that the adhesive layer be transparent, and also that a reflective layer be positioned between the cable and the adhesive so that light is properly reflected down the length of the distribution film (as light will not be reflected by total internal reflection at the adhesive/light distribution film interface). Again a separate adhesive layer may attach the reflective layer to the cable, or the cable surface itself may be reflective. In other embodiments, the adhesive layer 160 may be optically isolated from the distribution film by some sort of highly reflective material, such as a metalized and/or mirrored material or ESR. In either case, reflection away from surface 108 will encourage light to disperse all the way through each segment 116. In the embodiment shown in FIG. 7, once again the light deflector is formed into the top surface of the distribution film segment 116, and deflects light by total internal reflection. In at least one of the next embodiments, this is not the case.

Figure 8:
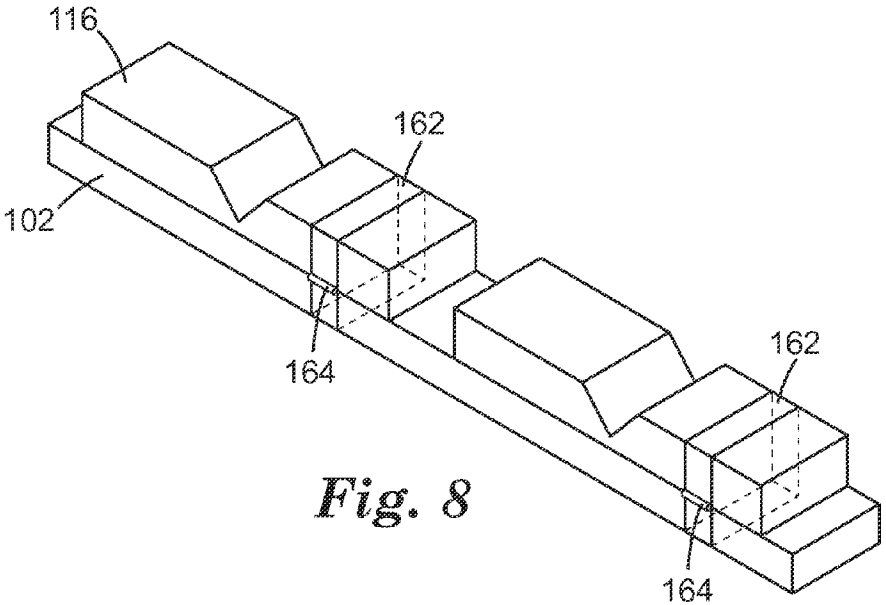
FIG. 8 is a cross-sectional view of a flexible cable lighting assembly according to the present description.
Figure 9:
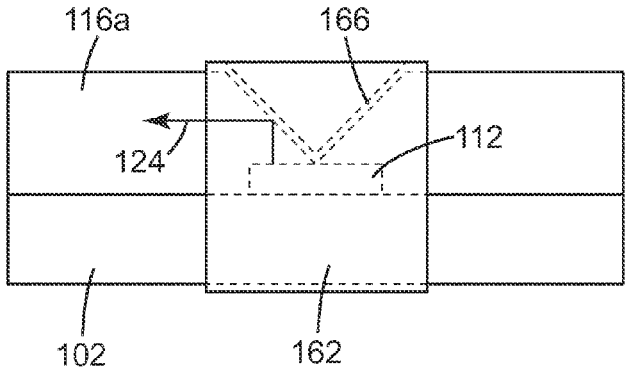
FIG. 9 is a close-up view of a portion of a flexible cable lighting assembly according to the present description.

FIG. 8 is a perspective view of another embodiment of a flexible light assembly. In this embodiment, rather than securing the flexible cable 102 and light distribution film segments 116 together by use of adhesive, a plurality of mechanical clamps 162 are fastened around the two structures in order to securely hold them together. The clamps 162 may have a clamp point 164 at which they are fastened together in construction. In a number of embodiments, the clamps may be at least partially transparent so as to not block the light from exiting the film segments 116. However, in others, it may be desired that the clamps be reflective. For example, FIG. 9 illustrates a close-up cross-sectional view of another lighting assembly in which flexible cable 102 and film segment 116 are fastened by a clamp. However, in this embodiment, the clamp 162 is positioned directly over the LED 112. Again, the clamp may be transparent as discussed above. However, in such an embodiment, it may be useful to provide a reflective surface 166 directly above the LED 112. In this case, the reflective surface 166 of clamp 162 acts as the deflector for deflecting light 124 down the distribution film segment 116. Of course a mirrored or reflective element 166 that is not a clamp may also be positioned over the LED to achieve light deflection, even in a cases where, e.g., the film segment 116 and cable 102 are fastened by adhesive. In other embodiments a clamp, e.g. clamp 162 may be placed directly over the light emitting diode, but may not have a reflective surface. Instead it may be translucent. In that case it may have artistic design, logos, or graphics which appear by thinning sections of the clamp or which may be printed on the outside surface. Alternatively, the clamp may have holes directly above the LED. The holes may have diffusive or structured film on top to transmit light leaked by the deflector in a nonobtrusive manner. Finally, the clamps may be transparent in their entirety, or transparent only above the light emitting diode's emission surface.

Figure 10:
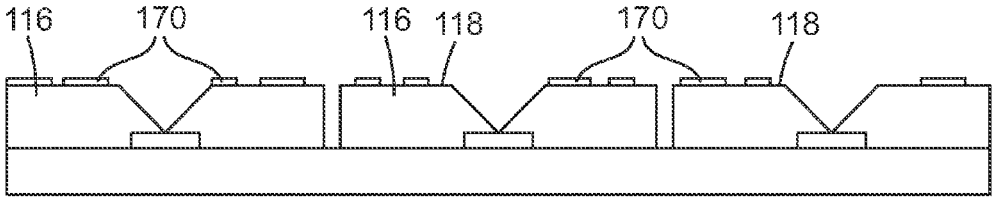
FIG. 10 is a cross-sectional view of a flexible cable lighting assembly according to the present description.

The lighting assemblies of the current description may be used for any number of appropriate uses, some of which include backlighting for purposes of advertising and for other purposes. As such, it may be desirable in such applications to apply a design or graph pattern on top of the light distribution film segments 116. FIG. 10 illustrates an example of applying a graphic design or pattern 170 on top surface 118. The pattern may act to mask light from exiting that the point where the pattern 170 is located, or may serve to extract the light at these positions.

As discussed throughout, one of the factors of principal importance in the assemblies disclosed herein is not only that the light assembly produces a more uniform light output, but that it be highly flexible. In accordance with this, in many embodiments, regardless of whether there is an air or material-filled gap between distribution film segments 116 or whether adjacent segments are directly abutting one another, the material from which the distribution film segment 116 is constructed will be highly flexible itself. The material used to make up the distribution film segment will generally have a low Young's Modulus, a measurement strongly correlated to elasticity and flexibility. The light distribution film segment material may potentially have a Young's Modulus of between about 0.05 and about 1.00, more preferably between about 0.05 and about 0.50 and even more preferably between about 0.10 to 0.25.

One particularly useful material for the light distribution film segments is a urethane blend that does not contain any silicone. Generally silicones may have a good deal of flexibility and therefore a low Young's Modulus, which one might think desirable for the film segments. The current description contemplates using a urethane blend without silicone at least in part because silicone segments have a high surface energy and may attract a good deal of debris and particulates to the emission surface of the segment. In addition, other materials that have a lower Young's Modulus may not have an appropriate index of refraction. For example, fluoroacrylate may have a Young's Modulus that indicates adequate flexibility of the segment, but the index of refraction of a fluoroacrylate is approximately 1.35. Thus, a segment made of fluoroacrylate would not achieve the level of total internal reflection at the segment/air interface necessary to achieve light travel towards the segment side surfaces. The urethane blends utilized in the current description to make up the light distribution film segment may have an index of refraction of between about 1.40 and about 1.65, and more preferably 1.45 to about 1.60, and potentially between about 1.45 and about 1.55.

It should further be understood that the current description allows for the spreading of light along a cable while further adding the functionality of flexibility. In order to extract the light at the desired location from the distribution film, common methods known in the art, such as shaping the distribution film as a wedge or series or wedges, or the inclusion of extraction features at points on its top or bottom surface are contemplated. These features could be arrays of structures, such as, e.g. prisms, microlenses, etc., or printed white dots, the latter being located on the bottom surface of the distribution film. Varying the size and density of these features along the long axis of the film achieves uniform extraction.

The present invention should not be considered limited to the particular examples and embodiments described above, as such embodiments are described in detail to facilitate explanation of various aspects of the invention. Rather the present invention should be understood to cover all aspects of the invention, including various modifications, equivalent processes, and alternative devices falling within the spirit and scope of the invention as defined by the appended claims.

We claim:

1. A flexible lighting assembly comprising:

a flexible cable having a width and thickness, and comprising electrical conductors to provide electrical circuit paths;

a plurality of light emitting diodes (LEDs) electrically connected to the electrical conductors of the flexible cable, wherein the light emitting diodes comprise leads placed against a first exterior surface of the flexible cable; and a plurality of light distribution film segments positioned on the first exterior surface of the flexible cable, each segment corresponding to a light emitting diode, and each distribution film segment comprising a top surface generally parallel to the flexible cable and two side surfaces running between the top surface and the first exterior surface of the flexible cable at opposing ends of each segment, each distribution film segment comprising a light deflector positioned directly over the light emitting diode, wherein the light deflector redirects light emitted from the light emitting diode in a length direction generally towards one of the side surfaces of the segment, and the side surface of one segment is spaced apart from the closest side surface of an adjacent segment by a gap on the flexible cable, wherein the plurality of light distribution film segments distribute light from the LEDs along the length direction across the flexible light assembly before the light exits from the top surface of the light distribution film segments to reach a viewer in front of the LEDs.

2. The flexible lighting assembly of claim 1, further comprising a flexible heat sink sheet material having a thermal conductivity of at least 25 W/m–K thermally attached to a second surface of the flexible cable generally opposite the light emitting diodes connected to the flexible cable, and not in direct physical contact with any light emitting diode connected to the flexible cable.

3. The flexible lighting assembly of claim 1, wherein the electrical conductors are insulated by electrical insulation, the electrical insulation having a plurality of removed portions that each expose a surface mounting area on the first exterior surface, the light emitting diodes being soldered to a respective mounting area.

4. The flexible lighting assembly of claim 3, wherein the light emitting diodes further comprise a heat slug that is soldered to the respective mounting area.

5. The flexible lighting assembly of claim 1, wherein the light deflector is formed into the top surface of the distribution film segment.

6. The flexible lighting assembly of claim 5, wherein the light deflector comprises an element positioned on top of the top surface, the element comprising a mirrored surface facing the light emitting diode.

7. The flexible lighting assembly of claim 6, wherein the element is a clamp for mechanically fastening the distribution film segment to the flexible cable.

8. The flexible lighting assembly of claim 1, wherein the gap comprises a flexible material having an index of refraction within 0.1 of an index of refraction of the film segments.

9. The flexible lighting assembly of claim 1, wherein light travels from the light deflector towards one of the side surfaces by total internal reflection.

10. The flexible lighting assembly of claim 1, wherein the light distribution film segment comprises a urethane blend with no silicone.

11. The flexible lighting assembly of claim 1, wherein the angle between a plane of the first exterior surface and a top surface of the distribution film segment is less than 5 degrees.

12. The flexible lighting assembly of claim 1, wherein the light distribution film segments are mechanically coupled to the first exterior surface of the flexible cable by a clamp.

13. A flexible lighting assembly comprising:

a flexible cable having a width and thickness, and comprising electrical conductors to provide electrical circuit paths;

a plurality of light emitting diodes (LEDs) electrically connected to electrical conductors of the flexible cable, wherein the light emitting diodes comprise leads placed against a first exterior surface of the flexible cable; and a plurality of transparent light distribution film segments positioned on the first exterior surface of the flexible cable, each segment corresponding to a light emitting diode, and each distribution film segment comprising a top surface generally parallel to the flexible cable and two side surfaces running between the top surface and the first exterior surface of the flexible cable, each distribution film segment comprising a light deflector positioned directly over the light emitting diodes, wherein the light deflector redirects light emitted from the light emitting diodes in a length direction generally towards one of the side surfaces of the segment, and wherein the light distribution film has a Young's Modulus of between about 0.05 and about 0.50 and an index of refraction of between about 1.45 and about 1.60 and is capable of flexing with the flexible cable, wherein the plurality of transparent light distribution film segments distribute light from the LEDs along the length direction across the flexible lighting assembly before the light exits from the top surface of the transparent light distribution film segments to reach a viewer in front of the LEDs.

14. The flexible lighting assembly of claim 13, further comprising a flexible heat sink sheet material having a thermal conductivity of at least 25 W/m–K thermally attached to a second side of the flexible cable generally opposite the light emitting diodes connected to the flexible cable, and not in direct physical contact with any light emitting diode connected to the flexible cable.

15. The flexible lighting assembly of claim 13, wherein the electrical conductors are insulated by electrical insulation, the electrical insulation having a plurality of removed portions that each expose a surface mounting area on the first exterior surface, the light emitting diodes being soldered to a respective mounting area.

16. The flexible lighting assembly of claim 13, wherein the light distribution film comprises a urethane blend with no silicone.

17. A flexible lighting assembly comprising:

a flexible cable having a width and thickness, and comprising electrical conductors to provide electrical circuit paths;

a plurality of light emitting diodes electrically connected to electrical conductors of the flexible cable, wherein the light emitting diodes comprise leads placed against a first exterior surface of the flexible cable; and a plurality of transparent light distribution film segments positioned on the first exterior surface of the flexible cable, each segment corresponding to a light emitting diode, and each distribution film segment comprising a top surface generally parallel to the flexible cable and two side surfaces running between the top surface and the first exterior surface of the flexible cable, each distribution film comprising a light deflector positioned directly over the light emitting diode, wherein the light deflector redirects light emitted from the light emitting diode in a direction generally towards one of the side surfaces of the segment; and wherein the flexible lighting assembly is capable of being bent between two adjacent light emitting diodes around a 25 mm diameter rod without damaging the electrical circuit paths, light emitting diodes, or cable.

18. The flexible lighting assembly of claim 17, further comprising a flexible heat sink sheet material having a thermal conductivity of at least 25 W/m–K thermally attached to a second surface of the flexible cable generally opposite the light emitting diodes connected to the flexible cable, and not in direct physical contact with any light emitting diode connected to the flexible cable.

19. The flexible lighting assembly of claim 17, wherein the electrical conductors are insulated by electrical insulation, the electrical insulation having a plurality of removed portions that each expose a surface mounting area on the first exterior surface, the light emitting diodes being soldered to a respective mounting area.

20. The flexible lighting assembly of claim 1, wherein each distribution film segment further comprises a bottom surface opposite the top surface, and a plurality of extraction features on the top or bottom surface configured to extract light from the distribution film segments.

21. The flexible lighting assembly of claim 13, wherein each distribution film segment further comprises a bottom surface opposite the top surface, and a plurality of extraction features on the top or bottom surface configured to extract light from the distribution film segments.

* * * * *